US010137323B2

(12) United States Patent
Roth

(10) Patent No.: US 10,137,323 B2
(45) Date of Patent: Nov. 27, 2018

(54) GUIDED TYPE FALL ARRESTER—BODY CONTROL SYSTEM

(71) Applicant: Honeywell International Inc., Morristown, NJ (US)

(72) Inventor: Markus Roth, Konradsreuth (DE)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/522,922

(22) Filed: Oct. 24, 2014

(65) Prior Publication Data

US 2015/0129357 A1 May 14, 2015

Related U.S. Application Data

(60) Provisional application No. 61/902,641, filed on Nov. 11, 2013.

(51) Int. Cl.

| | |
|---|---|
| ***A62B 35/04*** | (2006.01) |
| ***A62B 35/00*** | (2006.01) |
| *E06C 7/18* | (2006.01) |

(52) U.S. Cl.

CPC ..... *A62B 35/0093* (2013.01); *A62B 35/0062* (2013.01); *A62B 35/0081* (2013.01); *A62B 35/04* (2013.01); *E06C 7/187* (2013.01)

(58) Field of Classification Search

CPC . E06C 7/187; A62B 35/0093; A62B 35/0062; A62B 35/0081; A62B 35/04

See application file for complete search history.

(56) References Cited

U.S. PATENT DOCUMENTS

| | | | | |
|---|---|---|---|---|
| 5,638,919 | A * | 6/1997 | Pejout | 182/192 |
| 5,934,408 | A * | 8/1999 | Flux | 182/5 |
| 6,457,556 | B1 * | 10/2002 | Skade et al. | 182/8 |
| 6,725,969 | B1 * | 4/2004 | Meister | A62B 35/0081 182/3 |
| 8,584,797 | B2 * | 11/2013 | Krauss | 182/3 |
| 9,132,297 | B2 * | 9/2015 | Casebolt et al. | |

(Continued)

FOREIGN PATENT DOCUMENTS

| | | |
|---|---|---|
| CH | 163 705 A | 8/1933 |
| DE | 10 2008 028647 A1 | 12/2009 |
| DE | 20 2009 017027 U1 | 4/2010 |

OTHER PUBLICATIONS

EPO Search Report dated May 22, 2015.

*Primary Examiner* — Katherine W Mitchell

(74) *Attorney, Agent, or Firm* — Wood, Phillips, Katz, Clark & Mortimer

(57) ABSTRACT

A fall arrester (10) including a body (20), a pawl (18) mounted to the body (20) for movement between a disengaged position and an engaging position wherein the pawl (18) engages a catching stop (16) in a guide rail (12), a first connecting element (41) operably connected to the pawl (18), and a second connecting element (60) operably connected to the pawl (18), wherein the pawl (18) is configured to move from the disengaged position to the engaged position in response to a first predetermined force applied to the first connecting element (41) in a first direction and to move from the disengaged position to the engaged position in response to a second predetermined force applied to the second connecting element (60) in a second direction that is different than the first direction.

20 Claims, 6 Drawing Sheets

(56) References Cited

U.S. PATENT DOCUMENTS

| | | | | |
|---|---|---|---|---|
| 2010/0012424 | A1 | 1/2010 | Krauss | |
| 2010/0032239 | A1* | 2/2010 | Rinklake | E06C 7/186 182/192 |
| 2011/0186382 | A1* | 8/2011 | Sudale | A62B 1/14 182/3 |
| 2011/0186388 | A1* | 8/2011 | Sudale et al. | 188/65.2 |
| 2014/0020983 | A1* | 1/2014 | Casebolt | A62B 1/14 182/241 |

* cited by examiner

GUIDED TYPE FALL ARRESTER—BODY CONTROL SYSTEM

CROSS-REFERENCE TO RELATED APPLICATIONS

This application claims the benefit of the filing date of U.S. Provisional Ser. No. 61/902,641, filed Nov. 11, 2013, which is hereby incorporated by reference.

FEDERALLY SPONSORED RESEARCH OR DEVELOPMENT

Not Applicable.

MICROFICHE/COPYRIGHT REFERENCE

Not Applicable.

FIELD

The invention relates to fall arresters which are part of a climbing protection system for preventing a user of a ladder, a platform or the like from falling.

BACKGROUND

Fall arresters are known to be movable along a guide rail of a climbing protection system and to have a rotatably mounted pawl which, in the event of a fall, engages against catching stops in the guide rail, whereby the fall arrester is stopped in the guide rail to arrest a user from falling further. A connecting element of the fall arrester transmits force to the pawl from the user that is secured to the connecting element by a lanyard or other suitable attaching device. The connecting element can be formed as a deformable damping element, such as shown in PCT/EP2006/067469. While such fall arresters work well for their intended purpose, there is always room for improvement.

One issue with at least some current commercially available fall arresters is that they can fail to arrest a fall under certain conditions. More specifically, at least some current commercially available fall arresters can fail to properly arrest the fall of a user when the user falls in a direction that doesn't actuate the pawl of the fall arrester into a position to engage the stops in the guide rail, such as can happen when falling from a squatted position or while leaning towards the fall arrester such as when a user becomes unconscious or dizzy.

SUMMARY

In accordance with one feature of this disclosure, a fall arrester is provided for use in a climbing protection system to protect a user of a ladder, a platform or the like from falls wherein the fall arrester is adapted to be used with, and to be movable along, a guide rail having catching stops engageable by the fall arrester in response to a fall by the user. The fall arrester includes a body; a pawl, a first connecting element, and a second connecting element. The pawl includes a pawl tooth and is mounted to the body for movement relative to the body between an engaging position wherein the pawl tooth will engage a catching stop in the guide rail and a disengaged position wherein the pawl tooth will not engage the catching stops in the guide rail. The first connecting element is operably connected to the pawl and configured to transmit force to the pawl from a user attached to the connecting element. The second connecting element is operably connected to the pawl and configured to transmit force to the pawl from a user attached to the connecting element. The pawl is configured to move from the disengaged position to the engaged position in response to a first predetermined force applied to the first connecting element in a first direction, and the pawl is configured to move from the disengaged position to the engaged position in response to a second predetermined force applied to the second connecting element in a second direction that is different than the first direction.

As one feature, the first connecting element is mounted to the body for movement between a disengaged position wherein the first connecting element does not force the pawl into the engaging position of the pawl, and an engaging position wherein the first connecting element forces the pawl into the engaging position of the pawl.

In one feature, the pawl is mounted to the body to rotate about a first axis between the disengaged position of the pawl and the engaging position of the pawl.

According to one feature, the pawl and the first connecting element are separate components of the fall arrestor, and the pawl and the first connecting element are abutted against each other at a location spaced from the first axis with the first connecting element and the pawl in the engaging positions.

As one feature, the first connecting element is mounted to the body to rotate about a second axis between the disengaged position and the engaging position of the first connecting element, the second axis being spaced from the first axis.

According to one feature, the first and second axes are parallel to each other.

In one feature, the first and second axes extend in a horizontal direction when the fall arrestor is in use.

As one feature, the second connecting element is mounted to the body to translate relative to the body between a disengaged position wherein the second connecting element does not force the pawl into the engaging position of the pawl, and an engaging position wherein the second connecting element forces the pawl into the engaging position of the pawl.

In one feature, the pawl and the second connecting element are separate components of the fall arrester, the pawl is mounted to the body to rotate about a first axis between the disengaged position of the pawl and the engaging position of the pawl, and the second connecting element and the pawl are connected to pivot about a third axis relative to each other as the second connecting element and the pawl move between the engaging and disengaged positions, the third axis being spaced from the first axis.

According to one feature, the first and second axes are parallel to each other.

As one feature, the first and second axes extend in a horizontal direction when the fall arrestor is in use.

In one feature, the pawl is pre-loaded by a spring toward the disengaged position of the pawl.

According to one feature, the first connecting element is pre-loaded by a spring toward the disengaged position of the first connecting element.

As one feature, the second connecting element is pre-loaded by a spring toward the disengaged position of the second connecting element.

According to one feature, the pawl and the first and second connecting elements are pre-loaded by a spring toward each of their disengaged positions.

In one feature, the first connecting element is formed as a damping element which deforms upon the application of the predetermined force.

In accordance with one feature of this disclosure, a fall arrester is provided for use in a climbing protection system to protect a user of a ladder, a platform or the like from falls wherein the fall arrester is adapted to be used with, and to be movable along, a guide rail having catching stops engageable by the fall arrester in response to a fall by the user. The fall arrester includes a body; a pawl, a first connecting element, and a second connecting element. The pawl includes a pawl tooth and is mounted to the body to rotate relative to the body about a first axis between an engaging position wherein the first tooth will engage a catching stop in the guide rail and a disengaged position wherein the pawl tooth will not engage the catching stops in the guide rail. The first connecting element is operably connected to the pawl and configured to transmit force to the pawl from a user attached to the connecting element. The first connecting element is mounted to the body to rotate about a second axis between a disengaged position wherein the first connecting element does not force the pawl into the engaging position of the pawl, and an engaging position wherein the first connecting element forces the pawl into the engaging position of the pawl. The second axis is spaced from the first axis. The second connecting element is operably connected to the pawl and configured to transmit force to the pawl from a user attached to the connecting element. The second connecting element mounted to the body for movement relative to the body between a disengaged position wherein the second connecting element does not force the pawl into the engaging position of the pawl, and an engaging position wherein the second connecting element forces the pawl into the engaging position of the pawl. The second connecting element and the pawl are connected to pivot about a third axis relative to each other as the second connecting element and the pawl move between the engaging and disengaged positions, the third axis being spaced from the first and second axes. The pawl and the first connecting element are configured to move from the disengaged positions to the engaged positions in response to a first predetermined force applied to the connecting element in a first direction, and the second pawl and the second connecting element are configured to move from the disengaged positions to the engaged positions in response to a second predetermined force applied to the second connecting element in a second direction that is different than the first direction.

In one feature, the first, second, and third axes are parallel to each other.

As one feature, the first, second, and third axes extend in a horizontal direction when the fall arrestor is in use.

According to one feature, the second connecting element is mounted to the body to translate relative to the body between the disengaged and engaging positions of the second connecting element.

It should be appreciated that the invention may include all or none of the above-described features, or include only one or more of the above-described features, and include any combination of the above-described features. Furthermore, other advantages and features of the present invention will become readily apparent from the following detailed description of the invention, from the claims, and from the accompanying drawings.

DETAILED DESCRIPTION

Figure 1:
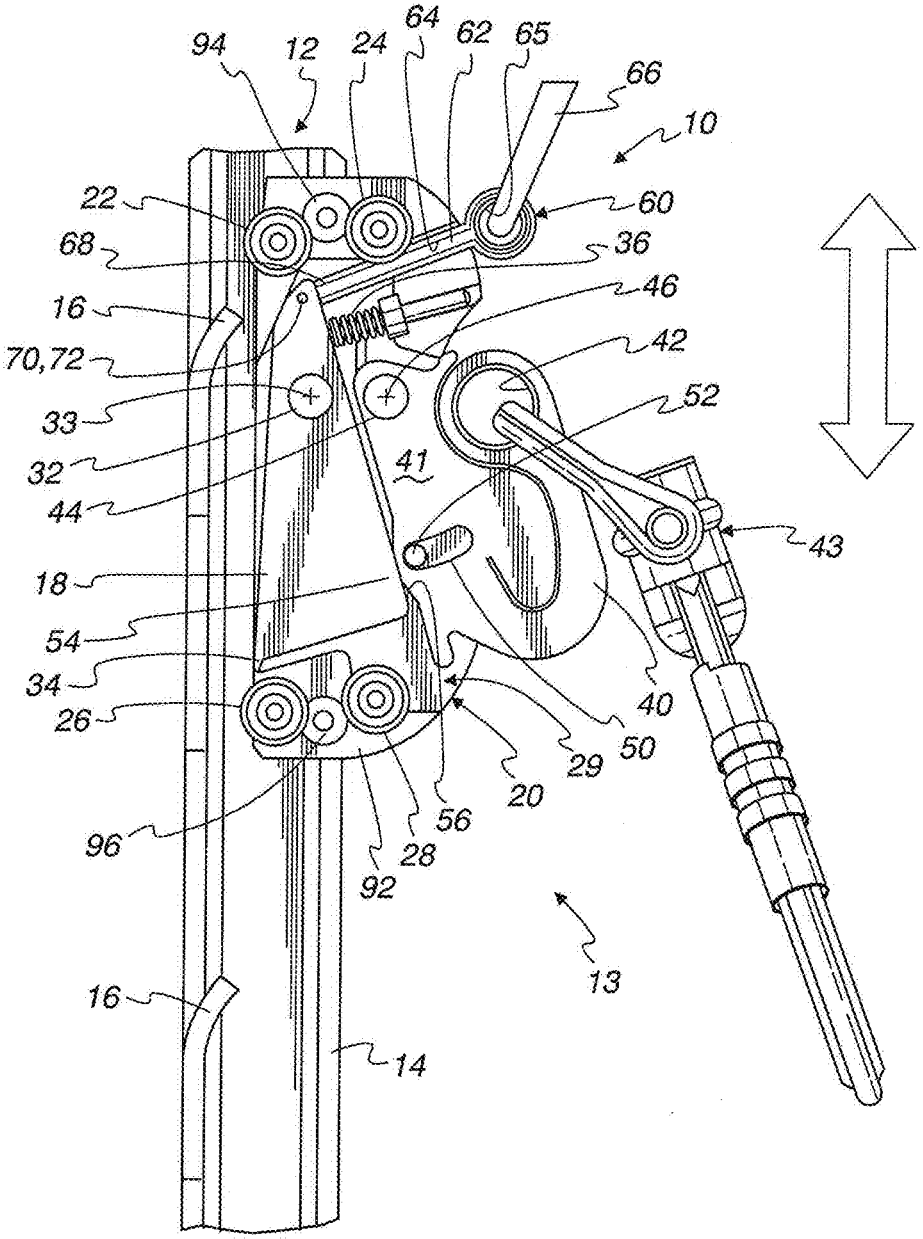
FIGS. 1-3 are side elevation views showing a fall arrester according to this disclosure as used in a climbing protection system, with each of the Figs. showing the fall arrester in a different operational states and with a portion of a body of the fall arrester not shown for purposes of illustration.

According to FIG. 1, a fall arrester 10 is guided in a guide rail 12 of a climbing protection system indicated generally at 13. The guide rail 12 is normally arranged vertically. The illustrated guide rail has the C-profile (C shaped cross section) known from European Patent No. EP 0168021 A1 which is open towards the front, i.e. towards the user, wherein the opening edges (only one shown in FIG. 1) of the C-profile serve as a guide flange 14. Catching stops 16 projecting into the inside of the guide rail 12 are pressed out in the rear of the guide rail.

For ease of description, the figures illustrating the fall arrester 10 show embodiments in the typical orientation that the fall arrester 10 would have when employed by a user in a climbing protection system 13, and terms such as upper, lower, horizontal, etc., are used with reference to this orientation. It will be understood, however, that the fall arrester 10 may be manufactured, stored, transported, used, and sold in an orientation other than the orientation described. It should also be understood that several embodiments of the fall arrester 10 according to this disclosure are illustrated in the Figs., and that like numbers identify like features and components.

The fall arrester 10 has an elongate body 20 extending in the elongate length direction of the guide rail 12 (typically vertical) with a pawl 18 rotatably mounted therein. Two pairs of rollers 22, 24 are provided at the front end or top of the body 20. The inner pair of rollers 22 runs on the inside of the guide flange 14, while the outer pair of rollers 24 runs on the outside of the guide flange 14. The rollers 22, 24 are mounted on journal bearings which are fastened rigidly to the body 20. The inner rollers 22 remain at a distance from the outer rollers 24 that is somewhat greater than the material thickness of the guide flange 14. Two similar pairs of rollers 26, 28 are provided at the rear end or bottom of the body 20, wherein the inner pair of rollers 26 again runs on the inside of the guide flange 14, while the outer pair of rollers 28 runs on the outside of the guide flange 14.

It should be appreciated that the rollers 22, 24, 26, 28 serve to rollingly guide the fall arrester 10 along the length of the guide rail 12 while bearing a portion or all of a user's weight, while also maintaining the fall arrester 10 within the guide rail 12 in the event of a user falling and the fall arrester engaging one of the catching stops 16 of the guide rail 12 to arrest the fall of the user. It should also be understood that this disclosure contemplates other structures that can perform the above-described function of the rollers 22, 24, 26, 28, including, but not limited to, other arrangements of rollers and/or other friction reducing components. It should further be understood that a fall arrester 10 according to this disclosure may find use with other configurations of guide rails and accordingly may utilize other configurations to engage the fall arrester 10 to such guide rails.

Figure 2:
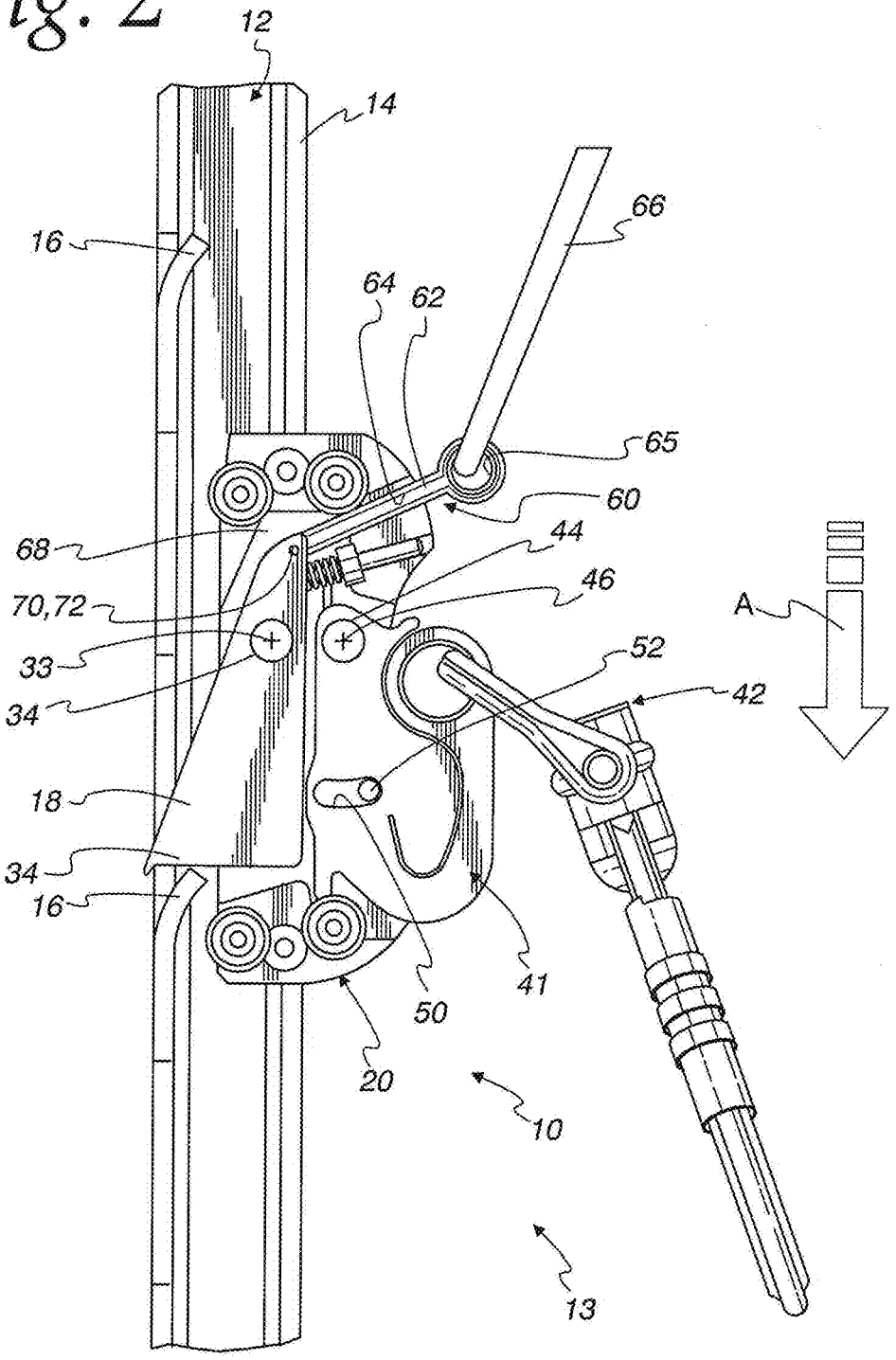
Figure 3:
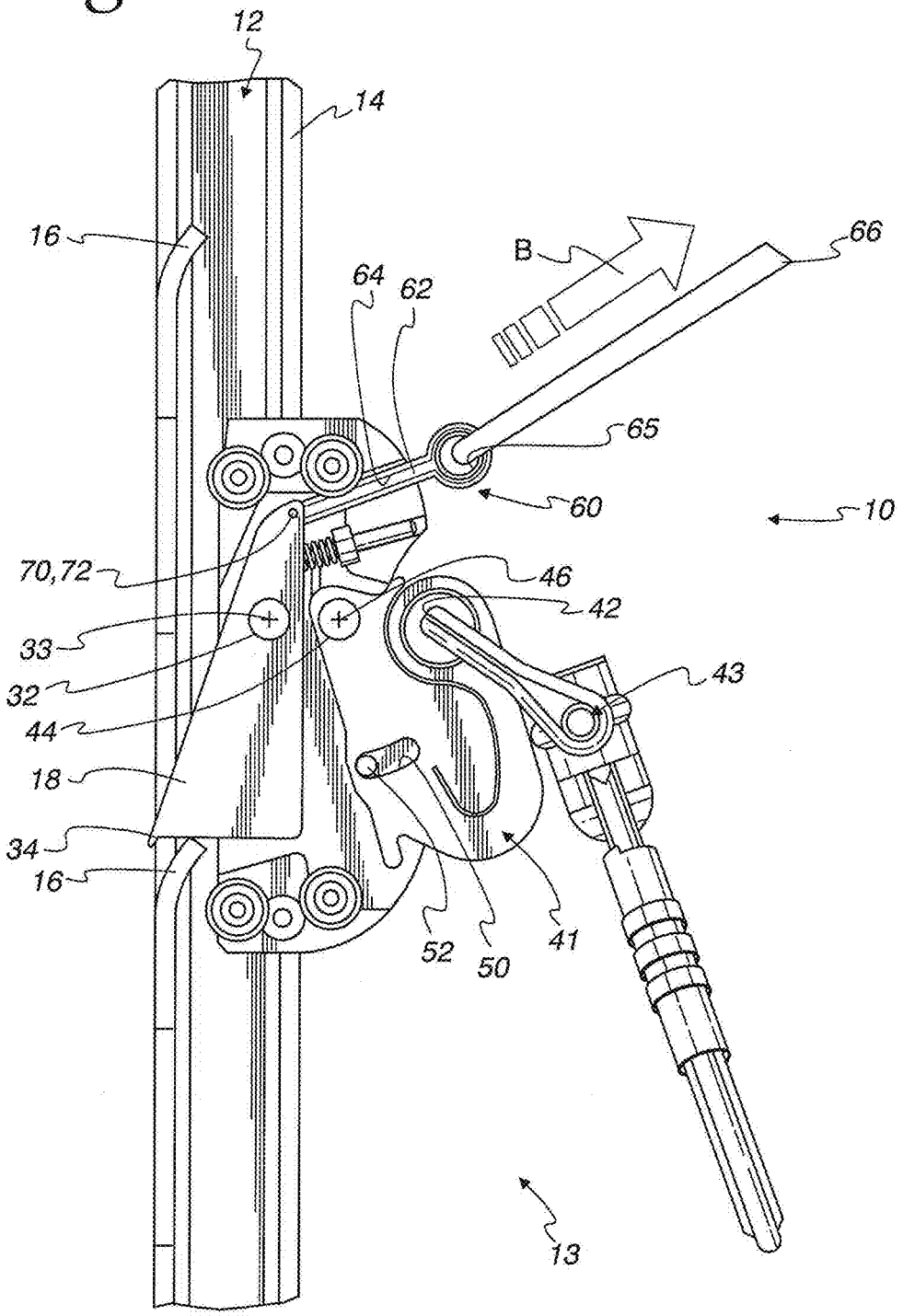
Figure 4:
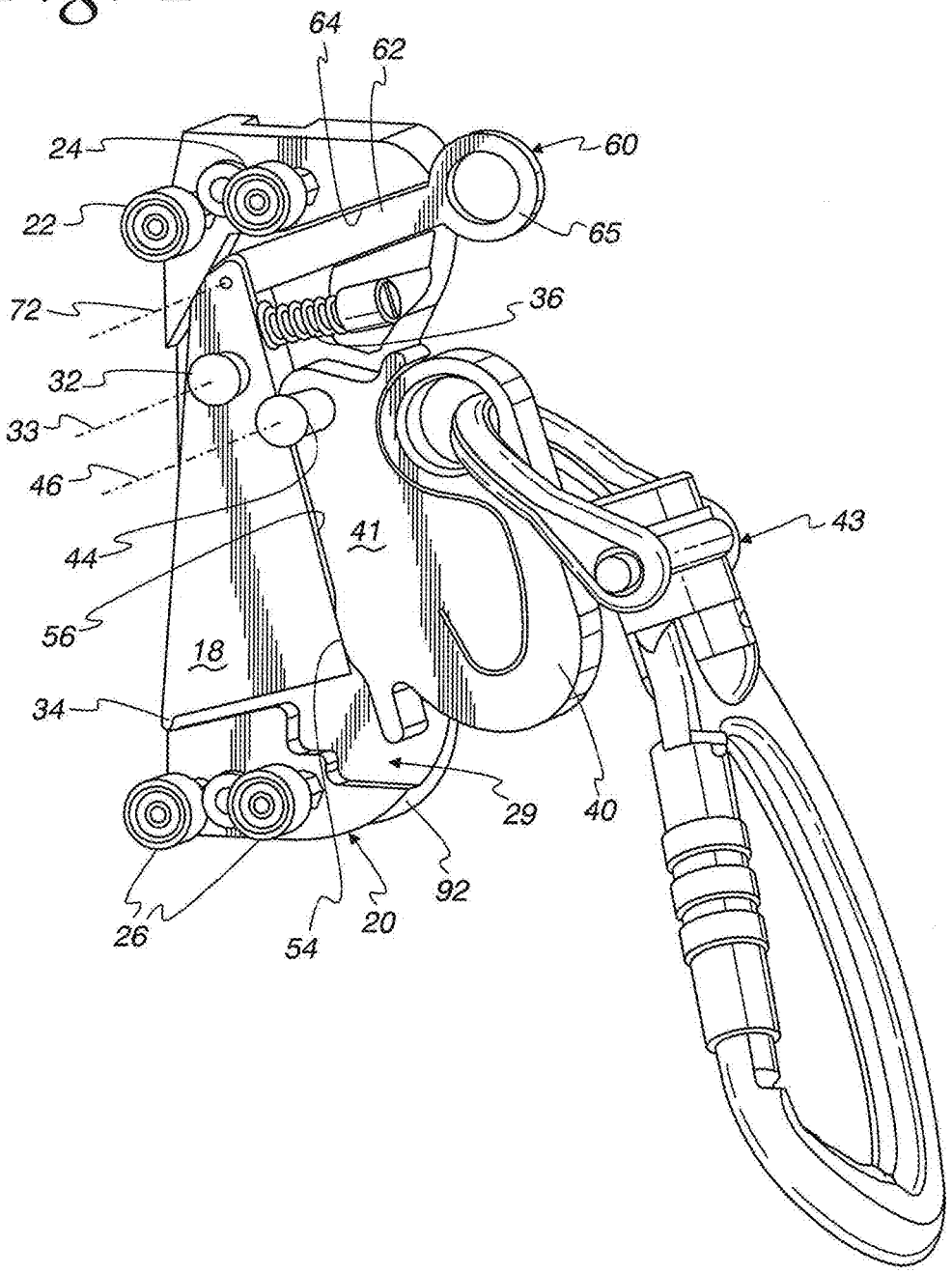
FIGS. 4 and 5 are enlarged isometric views of the fall arrester of FIGS. 1-3 again with the same portion of the body not shown for purposes of illustration, with FIG. 4 showing the fall arrester in the same operational state as FIG. 1, and FIG. 5 showing the fall arrester in the same operational state as FIG. 3.

The body 20 of the fall arrester 10 has a slot-shaped opening 29 in which the pawl 18 is mounted on a cylindrical pin 32 to rotate about a first axis 33 (extending perpendicular to the plane of the paper in FIGS. 1-3) between a disengaged position shown in FIG. 1 and an engaging position shown in FIGS. 2 and 3. The pawl 18 has a tooth 34 that projects from the fall arrester 10 in the engaging position into the inside of the C-profile of the guide rail 12 until it meets one of the catching stops 16 which project inwards from the rear of the rail 12. The pin 32 is located in the upper region of the pawl 18, and the pawl 18 is subject to the action of a helical, pressure spring 36 which presses against the upper region of the pawl 18 to urge the pawl 18 towards the disengaged position.

In the illustrated embodiments, a damping element 40 is formed as a single, unitary part of a first connecting element 41 on the side facing the user and slightly below the pin 32. The first connecting element 41 is operably connected to the pawl 18 and configured to transmit force to the pawl from a user attached to the first connecting element 41. In this regard, the first connecting element 41 and has a first connecting feature in the form of a lug 42 from which a lanyard 43 or other safety harness attachment of the user can be connected to the fall arrester 10. The damping element 40 is U-shaped overall, with the end of one leg of the U terminating at the lug42 and the end of the other leg extending from the remainder of the first connecting element 41. The first connecting element 41 is mounted on a cylindrical pin 44 to rotate about a second axis 46 (extending perpendicular to the plane of the paper in FIGS. 1-3) relative to the body 20 between a disengaged position wherein the first pawl connecting element 41 does not force the pawl 18 into the engaging position of the pawl 18, and an engaging position wherein the first connecting element 41 forces the pawl 18 into the engaging position of the pawl 18. In the illustrated embodiment, the connecting element 41 has an arcuate slot 50 that receives a stationary cross pin 52 fixed in the body 20 to limit movement of the connecting element 41 about the second axis 46 by engagement of the cross pin 52 with one terminal end of the slot 50 or the other terminal end of the slot 50.

In the event of a generally downward vertical fall, such as indicated by arrow "A" in FIG. 2, the pawl 18 is pressed into the engaging position shown in FIG. 3 by the downward force of the falling user transmitted to the pawl 18 by the first connecting element 41 as it pivots from its disengaged position in FIG. 1 to its engaging position in FIG. 2, with the transmitted falling force being sufficient to overcome the pre-load of the spring 36. In this regard, the falling force is transmitted by engagement of an arcuate cam surface 54 on the connecting element 41 with an abutting surface 56 on the pawl 18. The fall arrest force is conducted to the falling user from the connecting element 41 via a lanyard 43 or other device attached to the lug 42, and the damping element 40 is bent out of its initial U-shape into a largely stretched shape, such as disclosed and shown in U.S. Patent Pub. No. US/2010/0012424 A1. The fall arrest force is thereby damped. However, it should be understood that this disclosure contemplates that a fall arrester 10 according to the disclosure can utilize other forms of a connecting element 41 than the specific form illustrated herein, including forms wherein the connecting element 41 does not include a damping element 40, forms wherein the connecting element 41 is a single, one-piece, unitary part of the pawl 18, and embodiments wherein the connecting element 41 is a separate component from the pawl 18 but mounted for other types of movement between its disengaged and engaging positions.

Figure 5:
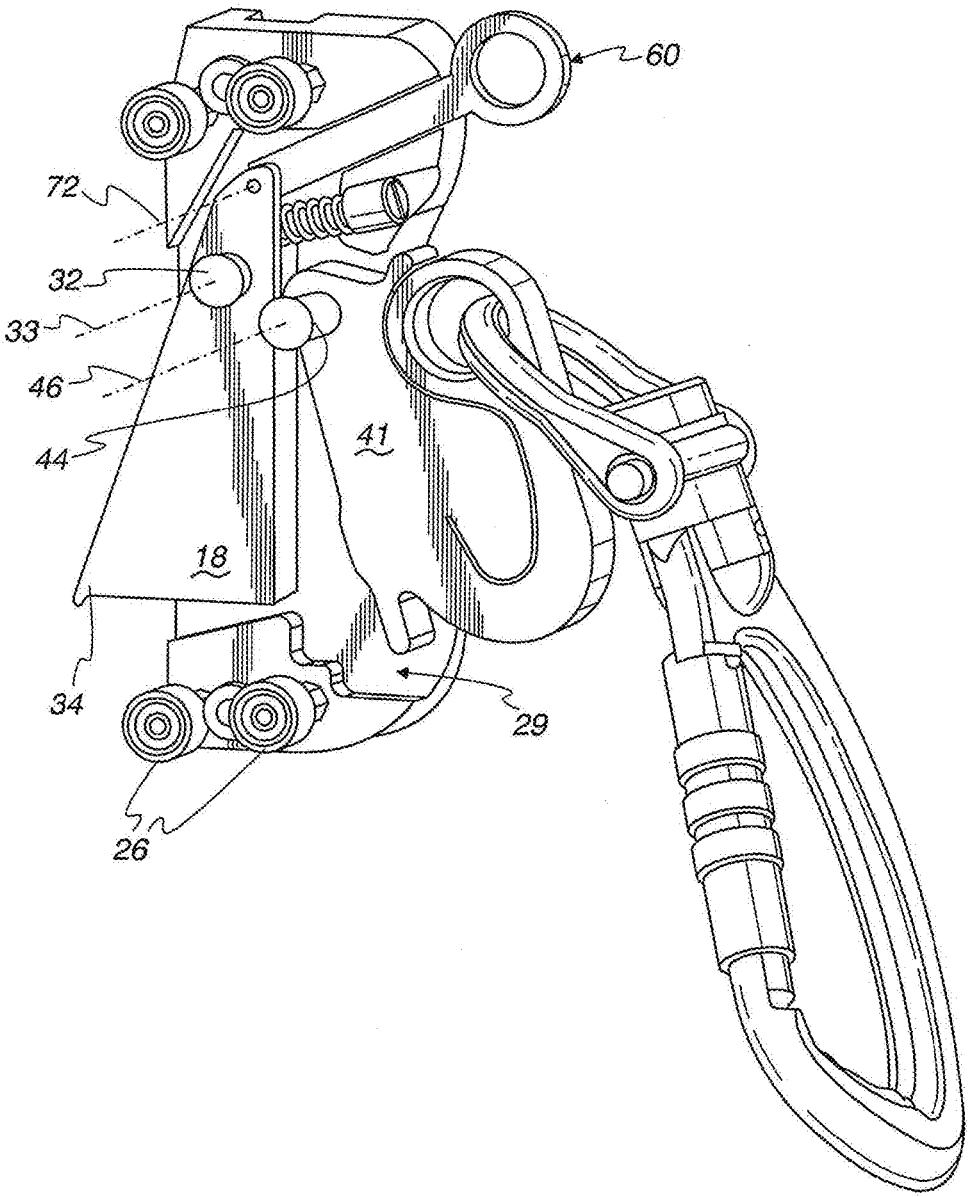
Figure 6:
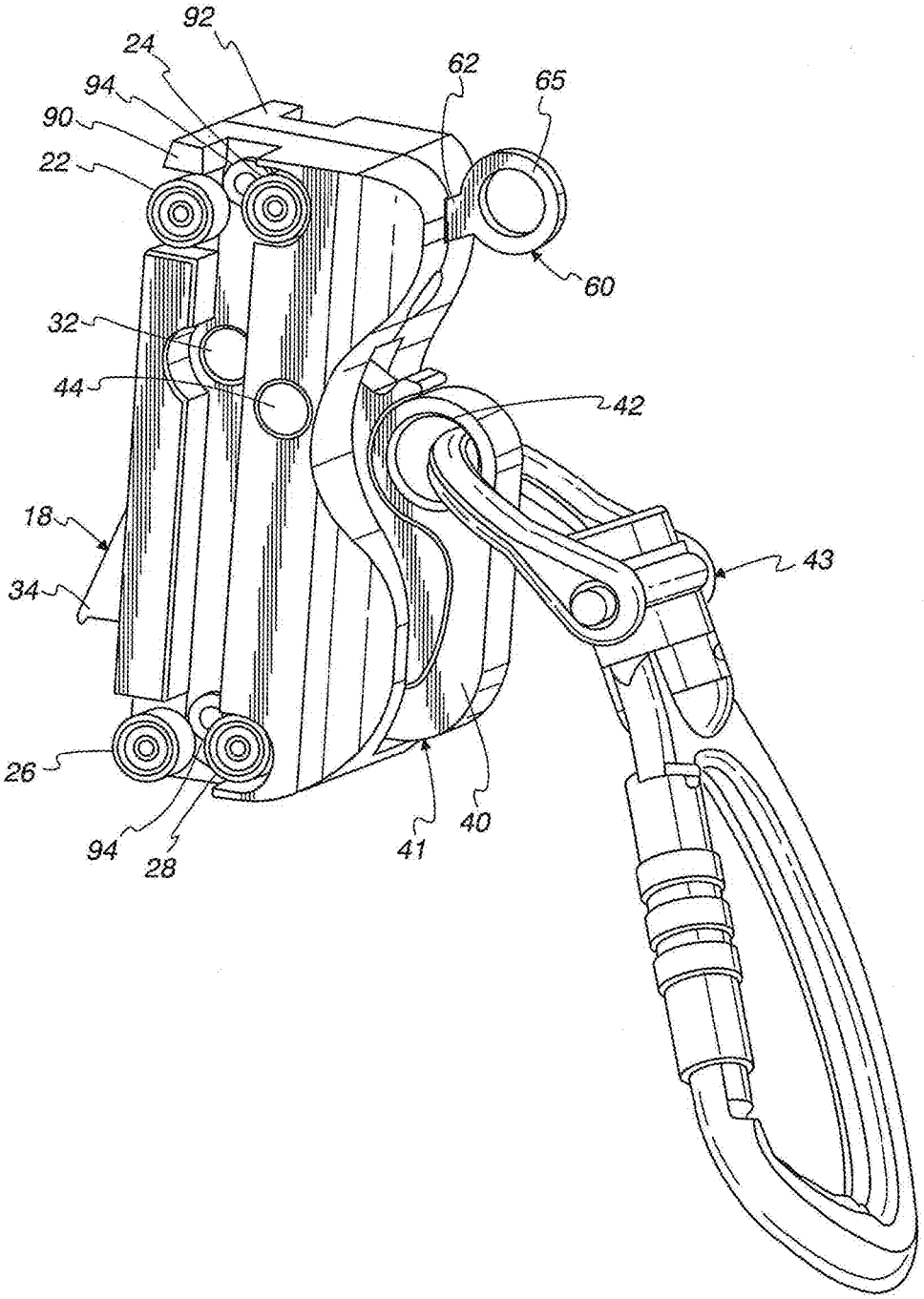
FIG. 6 is an enlarged isometric view of the fall arrester of FIGS. 1-5 and showing the portion of the body that was not shown in FIGS. 1-5.

The fall arrester includes a second connecting element 60 operably connected to the pawl 18 and configured to transmit force to the pawl from a user attached to the connecting element 60. In the illustrated embodiment, the second connecting element is mounted in the body to translate relative to the body between a disengaged position shown in FIG. 1 wherein the second connecting element 60 does not force the pawl 18 into the engaging position of the pawl 18, and an engaging position shown in FIGS. 3 and 5 wherein the second connecting element 60 forces the pawl 18 into the engaging position of the pawl 18. In this regard, in the illustrated embodiment, the second connecting element 60 has a shank 62 that is received in a conforming bore 64 of the body 20, with a second connecting feature in the form of a lug 65 extending from one end of the shank 62 for receiving a lanyard or other suitable device, such as the safety line 66 shown in FIGS. 1-3, attaching a user to the lug 65, and a terminal end 68 of the shank 62 connected to the upper end of the pawl 18 by a cylindrical pin 70 that allows the pawl 18 to pivot relative to the second connecting element about an axis 72 (extending perpendicular to the plane of the paper in FIGS. 1-3 ) defined by pin 70.

The second connecting element 60 translates from the disengaged position to the engaging position in response to a falling force transmitted to the second connecting element 60 via the safety line 66 (or other suitable attachment) from a user falling in a second direction indicated by arrow "D" in FIG. 3 that is more horizontally directed than the generally downwardly direction indicated by arrow "A" in FIG. 2, with the falling force being sufficient to overcome the pre-load of the spring 36. Because the bore 64 in the body 20 is nearly horizontal, the falling direction of the user indicated by the arrow "B" tends to translate the second connecting element 60 to the disengaging position, whereas the first connecting element 41 tends to either stay in the disengaged position shown in FIG. 1 or to move even further in a counterclockwise direction (as viewed in the figures) to the position shown in FIG. 3 as the user falls generally horizontally away from the rail 12 rather than downward. In this regard, it should be understood, that the initial falling direction of a user may be generally horizontal (arrow "B") and then become more downward in the vertical direction (arrow "A") after the pawl 18 is engaged with a stop 16, at which point the vertically downward movement of a user can cause the first connecting element 41 to move to the engaging position shown in FIG. 2 and for the damping element 40 of the illustrated embodiment to operate as previously described above.

While a particular form of the connecting element 60 is shown in the illustrations, it should be understood that this disclosure contemplates that a fall arrester 10 according to the disclosure can utilize other forms of a connecting element 60 than the specific form illustrated herein, including forms wherein the connecting element 60 is mounted for other types of movement than translation between its disengaged and engaging position, and configurations wherein the connecting element 60 is operably connected with the pawl 18 by structure other than a pin 70, including structure that allows for other than relative pivoting motion between the pawl 18 and the connecting element 60.

It should also be understood that while the illustrated embodiments show the axes 33, 46 and 72 extend parallel to each other in a horizontal direction when the fall arrester 10 is in use, this disclosure contemplates that a fall arrester 10 can be configured wherein one or more of the axes 33, 46 and 72 do not extend parallel to each other, or may not extend in the horizontal direction.

It should also be appreciated that the spring 36 pre-loads the pawl 18, the first connecting element 41 and the second connecting element 60 to each of their disengaged positions.

While the body 20 can have any suitable construction, in the illustrated embodiment, the body 20 is formed from two elongate frame members 90 and 92 that are essentially mirror images of each other, with the frame members 90 and 92 being held together by a plurality of threaded fasteners 94, and the pins 32, 44, and 52 being fixed on opposite sides to the respective frame members 90 and 92 such that they are supported on both sides.

While specific embodiments of the fall arrester 10 have been illustrated herein, it should be understood that there are many possible ways to configure a fall arrester 10 within the scope of this disclosure and no limitations to specific illustrated or described embodiments are intended unless the structure for such is expressly recited in the claims. Some examples of alternate configurations have already been mentioned above, but for further example, while the first and second connecting element have been illustrated as being mounted for rotation and translation, respectively, and such mounting may be desirable for a number of applications, other possible mounting and movements are contemplated within the scope of this disclosure and may be desirable for other applications depending upon the requirements of the specific application. As an even further example, while the pawl 18 is shown as being mounted on pin 32 for rotation about the axis 33, other possible rotational mounts may be desirable and are contemplated within the scope of this disclosure.

The present invention can be summarized in the following statements or aspects numbered 1-20:

1. A fall arrester 10 for use in a climbing protection system 13 to protect a user of a ladder, a platform or the like from falls wherein the fall arrester 10 is adapted to be used with, and to be movable along, a guide rail 12 having catching stops 16 engageable by the fall arrester 10 in response to a fall by the user, the fall arrester 10 comprising:

a body 20;

a pawl 18 comprising a pawl tooth 34, the pawl 18 mounted to the body 20 for movement relative to the body 20 between an engaging position wherein the pawl tooth 34 will engage a catching stop 16 in the guide rail 12 and a disengaged position wherein the pawl tooth 34 will not engage the catching stops 16 in the guide rail 12;

a first connecting element 41 operably connected to the pawl 18 and configured to transmit force to the pawl 18 from a user attached to the connecting element 41; and a second connecting element 60 operably connected to the pawl 18 and configured to transmit force to the pawl 18 from a user attached to the connecting element 60; wherein the pawl 18 is configured to move from the disengaged position to the engaged position in response to a first predetermined force applied to the first connecting element 41 in a first direction, and the pawl 18 is configured to move from the disengaged position to the engaged position in response to a second predetermined force applied to the second connecting element 60 in a second direction that is different than the first direction.

2. The fall arrester 10 in accordance with aspect 1 wherein the first connecting element 41 is mounted to the body 20 for movement between a disengaged position wherein the first connecting element 41 does not force the pawl 18 into the engaging position of the pawl 18, and an engaging position wherein the first connecting element 41 forces the pawl 18 into the engaging position of the pawl 18.

3. The fall arrester 10 in accordance with any one or more of the preceding aspects wherein the pawl 18 is mounted to the body 20 to rotate about a first axis 33 between the disengaged position of the pawl 18 and the engaging position of the pawl 18.

4. The fall arrestor 10 in accordance with any one or more of the preceding aspects wherein the pawl 18 and the first connecting element 41 are separate components of the fall arrestor 10, and the pawl 18 and the first connecting element 41 are abutted against each other at a location spaced from the first axis 33 with the first connecting element 41 and the pawl 18 in the engaging positions.

5. The fall arrester 10 in accordance with any one or more of the preceding aspects wherein the first connecting element 41 is mounted to the body 20 to rotate about a second axis 46 between the disengaged position and the engaging position of the first connecting element 41, the second axis 46 being spaced from the first axis 33.

6. The fall arrestor 10 in accordance with any one or more of the preceding aspects wherein the first and second axes 33 and 46 are parallel to each other.

7. The fall arrestor 10 in accordance with any one or more of the preceding aspects wherein the first and second axes 33 and 46 extend in a horizontal direction when the fall arrestor is in use.

8. The fall arrestor 10 in accordance with aspect 1 wherein the second connecting element 60 is mounted to the body 20 to translate relative to the body 20 between a disengaged position wherein the second connecting element 60 does not force the pawl 18 into the engaging position of the pawl 18, and an engaging position wherein the second connecting element 60 forces the pawl 18 into the engaging position of the pawl 18.

9. The fall arrestor 10 in accordance with any one or more of the preceding aspects wherein the pawl 18 and the second connecting element 60 are separate components of the fall arrester 10, the pawl 18 is mounted to the body 20 to rotate about a first axis 33 between the disengaged position of the pawl 18 and the engaging position of the pawl 18, and the second connecting element 60 and the pawl 18 are connected to pivot about a third axis 72 relative to each other as the second connecting element 60 and the pawl 18 move between the engaging and disengaged positions, the third axis 72 being spaced from the first axis 33.

10. The fall arrestor 10 in accordance with any one or more of the preceding aspects wherein the first and second axes 33 and 46 are parallel to each other.

11. The fall arrestor 10 in accordance with any one or more of the preceding aspects wherein the first and second axes 33 and 46 extend in a horizontal direction when the fall arrestor is in use.

12. The fall arrester 10 in accordance with any one or more of the preceding aspects wherein the pawl 18 is pre-loaded by a spring 36 toward the disengaged position of the pawl 18.

13. The fall arrester 10 in accordance with any one or more of the preceding aspects wherein the first connecting element 41 is pre-loaded by a spring 36 toward the disengaged position of the first connecting element 41.

14. The fall arrester 10 in accordance with any one or more of the preceding aspects wherein the second connecting element 60 is pre-loaded by a spring 36 toward the disengaged position of the second connecting element 60.

15. The fall arrester 10 in accordance with any one or more of the preceding aspects wherein the pawl 18 and the first and second connecting elements 41 and 60 are pre-loaded by a spring 36 toward each of their disengaged positions.

16. The fall arrester 10 in accordance with any one or more of the preceding aspects wherein the first connecting element 41 is formed as a damping element 40 which deforms upon the application of the predetermined force.

17. A fall arrester 10 for use in a climbing protection system 13 to protect a user of a ladder, a platform or the like from falls wherein the fall arrester 10 is adapted to be used with, and to be movable along, a guide rail 12 having catching stops 16 engageable by the fall arrester 10 in response to a fall by the user, the fall arrester 10 comprising:

a body 20;

a pawl 18 comprising a pawl tooth 34, the pawl 18 mounted to the body 20 to rotate relative to the body 20 about a first axis 33 between an engaging position wherein the first tooth will engage a catching stop 16 in the guide rail 12 and a disengaged position wherein the pawl tooth 34 will not engage the catching stops 16 in the guide rail 12;

a first connecting element 41 operably connected to the pawl 18 and configured to transmit force to the pawl 18 from a user attached to the connecting element, the first connecting element 41 mounted to the body 20 to rotate about a second axis 46 between a disengaged position wherein the first connecting element 41 does not force the pawl 18 into the engaging position of the pawl 18, and an engaging position wherein the first connecting element 41 forces the pawl 18 into the engaging position of the pawl 18, the second axis 46 being spaced from the first axis 33; and a second connecting element 60 operably connected to the pawl 18 and configured to transmit force to the pawl 18 from a user attached to the connecting element, the second connecting element 60 mounted to the body 20 for movement relative to the body 20 between a disengaged position wherein the second connecting element 60 does not force the pawl 18 into the engaging position of the pawl 18, and an engaging position wherein the second connecting element 60 forces the pawl 18 into the engaging position of the pawl 18, the second connecting element 60 and the pawl 18 connected to pivot about a third axis 72 relative to each other as the second connecting element 60 and the pawl 18 move between the engaging and disengaged positions, the third axis 72 being spaced from the first and second axes 33 and 46; wherein the pawl 18 and the first connecting element 41 are configured to move from the disengaged positions to the engaged positions in response to a first predetermined force applied to the first connecting element 41 in a first direction, and the second pawl 18 and the second connecting element 60 are configured to move from the disengaged positions to the engaged positions in response to a second predetermined force applied to the second connecting element 60 in a second direction that is different than the first direction.

18. The fall arrestor 10 in accordance with any one or more of the preceding aspects wherein the first, second, and third axes 33, 46 and 72 are parallel to each other.

19. The fall arrestor 10 in accordance with any one or more of the preceding aspects wherein the first, second, and third axes 33, 46 and 72 extend in a horizontal direction when the fall arrestor is in use.

20. The fall arrestor 10 in accordance with any one or more of the preceding aspects wherein the second connecting element 60 is mounted to the body 20 to translate relative to the body 20 between the disengaged and engaging positions of the second connecting element 60.

The invention claimed is:

1. A fall arrester for use in a climbing protection system to protect a user of a ladder, a platform or the like from falls wherein the fall arrester is adapted to be used with, and to be movable along, a guide rail having catching stops engageable by the fall arrester in response to a fall by the user, the fall arrester comprising:

a body;

a pawl comprising a pawl tooth, the pawl mounted to the body for movement relative to the body between an engaging position wherein the pawl tooth will engage a catching stop in the guide rail and a disengaged position wherein the pawl tooth will not engage the catching stops in the guide rail;

a first connecting element comprising a first connecting feature configured to receive an attachment to a user, the first connecting element operably connected to the pawl to transmit force to the pawl from a user attached to the first connecting feature; and a second connecting element comprising a second connecting feature configured to receive an attachment to a user, the second connecting feature spaced from the first connecting feature, the second connecting element operably connected to the pawl to transmit force to the pawl from a user attached to the second connecting feature; wherein the pawl is configured to move from the disengaged position to the engaging position in response to a first predetermined force applied to the first connecting element in a first direction, and the pawl is configured to move from the disengaged position to the engaging position in response to a second predetermined force applied to the second connecting element in a second direction that is different than the first direction.

2. The fall arrester of claim 1 wherein the first connecting element is mounted to the body for movement between a disengaged position wherein the first connecting element does not force the pawl into the engaging position of the pawl, and an engaging position wherein the first connecting element forces the pawl into the engaging position of the pawl.

3. The fall arrester of claim 2 wherein the pawl is mounted to the body to rotate about a first axis between the disengaged position of the pawl and the engaging position of the pawl.

4. The fall arrestor of claim 3 wherein the pawl and the first connecting element are separate components of the fall arrestor, and the pawl and the first connecting element are abutted against each other at a location spaced from the first axis with the first connecting element and the pawl in the engaging positions of the first connecting element and the pawl.

5. The fall arrester of claim 4 wherein the first connecting element is mounted to the body to rotate about a second axis between the disengaged position and the engaging position of the first connecting element, the second axis being spaced from the first axis.

6. The fall arrestor of claim 5 wherein the first and second axes are parallel to each other.

7. The fall arrestor of claim 6 wherein the first and second axes extend in a horizontal direction when the fall arrestor is in use.

8. The fall arrester according to claim 1, wherein the pawl is pre-loaded by a spring toward the disengaged position of the pawl.

9. The fall arrester according to claim 2 wherein the first connecting element is pre-loaded by a spring toward the disengaged position of the first connecting element.

10. The fall arrester according to claim 2 wherein the second connecting element is mounted in the body to translate relative to the body between a disengaged position wherein the second connecting element does not force the pawl into the engaging position of the pawl, and an engaging position wherein the second connecting element forces the pawl into the engaging position of the pawl: and the pawl and the first and second connecting elements are pre-loaded by a spring toward each of their disengaged positions.

11. The fall arrester according to claim 1 wherein the first connecting element is formed as a damping element which deforms upon the application of a predetermined force.

12. A fall arrester for use in a climbing protection system to protect a user of a ladder, a platform or the like from falls wherein the fall arrester is adapted to be used with, and to be movable along, a guide rail having catching stops engageable by the fall arrester in response to a fall by the user, the fall arrester comprising:

a body;

a pawl comprising a pawl tooth, the pawl mounted to the body for movement relative to the body between an engaging position wherein the pawl tooth will engage a catching stop in the guide rail and a disengaged position wherein the pawl tooth will not engage the catching stops in the guide rail;

a first connecting element operably connected to the pawl and configured to transmit force to the pawl from a user attached to the first connecting element; and a second connecting element operably connected to the pawl and configured to transmit force to the pawl from a user attached to the second connecting element; wherein the pawl is configured to move from the disengaged position to the engaging position in response to a first predetermined force applied to the first connecting element in a first direction, and the pawl is configured to move from the disengaged position to the engaging position in response to a second predetermined force applied to the second connecting element in a second direction that is different than the first direction; and wherein the second connecting element is mounted in the body to translate relative to the body between a disengaged position wherein the second connecting element does not force the pawl into the engaging position of the pawl, and an engaging position wherein the second connecting element forces the pawl into the engaging position of the pawl.

13. The fall arrestor of claim 12 wherein the pawl and the second connecting element are separate components of the fall arrester, the pawl is mounted to the body to rotate about a first axis between the disengaged position of the pawl and the engaging position of the pawl, and the second connecting element and the pawl are connected to pivot about a third axis relative to each other as the second connecting element and the pawl move between the engaging and disengaged positions of the second connecting element and the pawl, the third axis being spaced from the first axis.

14. The fall arrestor of claim 13 wherein the first and third axes are parallel to each other.

15. The fall arrestor of claim 14 wherein the first and third axes extend in a horizontal direction when the fall arrestor is in use.

16. The fall arrester according to claim 12 wherein the second connecting element is pre-loaded by a spring toward the disengaged position of the second connecting element.

17. A fall arrester for use in a climbing protection system to protect a user of a ladder, a platform or the like from falls wherein the fall arrester is adapted to be used with, and to be movable along, a guide rail having catching stops engageable by the fall arrester in response to a fall by the user, the fall arrester comprising:

a body;

a pawl comprising a pawl tooth, the pawl mounted to the body to rotate relative to the body about a first axis between an engaging position wherein the first tooth will engage a catching stop in the guide rail and a disengaged position wherein the pawl tooth will not engage the catching stops in the guide rail;

a first connecting element operably connected to the pawl and configured to transmit force to the pawl from a user attached to the first connecting element, the first connecting element mounted to the body to rotate about a second axis between a disengaged position wherein the first connecting element does not force the pawl into the engaging position of the pawl, and an engaging position wherein the first connecting element forces the pawl into the engaging position of the pawl, the second axis being spaced from the first axis; and a second connecting element operably connected to the pawl and configured to transmit force to the pawl from a user attached to the second connecting element, the second connecting element mounted to the body for movement relative to the body between a disengaged position wherein the second connecting element does not force the pawl into the engaging position of the pawl, and an engaging position wherein the second connecting element forces the pawl into the engaging position of the pawl, the second connecting element and the pawl connected to pivot about a third axis relative to each other as the second connecting element and the pawl move between the engaging and disengaged positions of the second connecting element and the pawl, the third axis being spaced from the first and second axes; wherein the pawl and the first connecting element are configured to move from the disengaged positions to the engaging positions of the pawl and the first connecting element in response to a first predetermined force applied to the first connecting element in a first direction, and the pawl and the second connecting element are configured to move from the disengaged positions to the engaging positions of the second connecting element and the pawl in response to a second predetermined force applied to the second connecting element in a second direction that is different than the first direction.

18. The fall arrestor of claim 17 wherein the first, second, and third axes are parallel to each other.

19. The fall arrestor of claim 18 wherein the first, second, and third axes extend in a horizontal direction when the fall arrestor is in use.

20. The fall arrestor of claim 17 wherein the second connecting element is mounted in the body to translate relative to the body between the disengaged and engaging positions of the second connecting element.

* * * * *